US011761150B2

(12) United States Patent
Silver

(10) Patent No.: US 11,761,150 B2
(45) Date of Patent: Sep. 19, 2023

(54) POST-PRODUCTION METHOD FOR PERSONALIZING FLYING DISC TOYS

(71) Applicant: Scott H. Silver, Atlantic Beach, FL (US)

(72) Inventor: Scott H. Silver, Atlantic Beach, FL (US)

( * ) Notice: Subject to any disclaimer, the term of this patent is extended or adjusted under 35 U.S.C. 154(b) by 96 days.

(21) Appl. No.: 17/647,834

(22) Filed: Jan. 12, 2022

(65) Prior Publication Data

US 2023/0220616 A1 Jul. 13, 2023

(51) Int. Cl.

| | |
|---|---|
| ***D06P 5/00*** | (2006.01) |
| ***D06P 5/28*** | (2006.01) |
| *A63H 33/18* | (2006.01) |

(52) U.S. Cl.

CPC ..... *D06P 5/004* (2013.01); *A63H 33/18* (2013.01)

(58) Field of Classification Search

CPC ..... D06P 5/004; A63H 33/18

USPC ..... 8/445

See application file for complete search history.

(56) References Cited

U.S. PATENT DOCUMENTS

| | | | | |
|---|---|---|---|---|
| 4,351,129 | A * | 9/1982 | Kerkenbush | A63H 33/18 446/46 |
| 4,802,875 | A * | 2/1989 | Cunningham | A63H 33/18 446/228 |
| 4,944,707 | A * | 7/1990 | Silverglate | A63H 33/18 446/48 |
| 5,326,299 | A * | 7/1994 | Jasinski | A63H 33/18 D21/443 |
| 6,299,962 | B1 | 10/2001 | Davis et al. | |
| 6,935,240 | B2 * | 8/2005 | Gosetti | B41M 5/035 101/DIG. 40 |
| 2007/0163057 | A1 | 7/2007 | Bertele et al. | |
| 2011/0173762 | A1 * | 7/2011 | Tutmark | A63B 37/0022 8/445 |
| 2012/0083181 | A1 * | 4/2012 | Holgate | A63H 33/18 446/46 |

FOREIGN PATENT DOCUMENTS

| | | | |
|---|---|---|---|
| WO | 2009117392 | A2 | 9/2009 |
| WO | 2021007689 | A1 | 1/2021 |

* cited by examiner

*Primary Examiner* — Eisa B Elhilo
(74) *Attorney, Agent, or Firm* — Mark Young, PA

(57) ABSTRACT

Flying disc toys are personalized with dye-sublimation printing using a heat press and dye-sublimation paper, onto which a design is printed. An assembled flying disc toy is disposed between a pad and a mask, in the heat press. The mask protects the ring of the flying disc toy from melting. The pad urges the fabric cover of the flying disc toy towards the paper and helps prevent crushing of the ring during pressing and the high-definition dye transfer sublimation printing.

20 Claims, 11 Drawing Sheets

POST-PRODUCTION METHOD FOR PERSONALIZING FLYING DISC TOYS

FIELD OF THE INVENTION

This invention relates generally to a flying disc toy that comprises a plastic or elastomeric ring onto which the fabric cover is attached, and, more particularly, to a method of printing consumer-provided subject matter onto the fabric cover of the manufactured flying disc toy.

BACKGROUND OF THE INVENTION

Flying disc toys comprising a ring (annulus) and a fabric cover are known. Such disc toys are popular dog toys. The ring is attached to or contained in the periphery of the fabric cover. Many such toys display branding, artwork and/or alphanumeric information on the fabric cover. Typically, the displayed subject matter is pre-printed on fabric used to construct the cover of the toy.

Illustratively, multiple copies of a display may be printed on yards of fabric. Patterns may then be laid out on the fabric and cut from the fabric. Each cut pattern, which is the fabric required for a single toy, includes the display correctly positioned on a face of the fabric. The toy is formed by attaching the fabric to a ring, such as by bonding and/or stitching. The disc toy, with the attached fabric cover, includes the display face.

Customized toys are available, but usually only in bulk. A customized display is pre-printed on the yards of fabric from which patterns are cut, as described above. However, personalized toys are not generally available in single units or small volumes.

What is needed is a system and method to personalize an assembled flying disc toy. In particular, a method of printing subject matter on an assembled flying disc toy is needed. The method should not damage the fabric or ring. The method should enable quickly and efficiently printing unique subject matter on each assembled toy, i.e., on each disc toy after the disc toy has been produced. The method should enable printing of high-definition photo realistic graphics and alphanumeric and special characters in many colors, combinations of colors and shadings. The method should be adaptable to current production processes and to post-production customization processes. Thus, the method should be suitable for adding to the end of a production line or for post-production implementation separate and apart from a production line.

The invention is directed to overcoming one or more of the problems and solving one or more of the needs as set forth above.

SUMMARY OF THE INVENTION

To solve one or more of the problems set forth above, in an exemplary implementation of the invention, a method of dye-sublimation printing on a manufactured flying disc toy, entails positioning a pad on a lower platen of a heat press. A flying disc toy is positioned on the pad. The flying disc toy includes a ring and a fabric cover. The flying disc toy has a top, a bottom and a height from the bottom to the top. The fabric cover includes a portion spanning a space bounded by the ring at the top of the flying disc toy. The bottom of the flying disc toy faces the lower platen. The pad is shaped and sized to occupy most of the space bounded by the ring. The thickness of the pad exceeds the height of the ring. A mask is positioned on the flying disc toy at the top of the flying disc toy. The mask provides thermal insulation. The mask covers the ring of the flying disc toy. The mask does not cover most (if any) of the portion of the fabric cover spanning the space bounded by the ring. Dye-sublimation paper is positioned over the portion of the fabric cover spanning the space bounded by the ring. The dye-sublimation paper includes a printed side facing the portion of the fabric cover spanning the space bounded by the ring. The printed side includes printed subject matter printed in dye-sublimation ink. The fabric cover includes polymer content suitable for dye-sublimation printing.

A heated platen is moved towards the lower platen, with the dye-sublimation paper on the fabric cover spanning the space bounded by the ring, and the mask over the ring of the flying disc toy, and the pad supporting the flying disc toy on the lower platen, all disposed between the heated platen and the lower platen. At least a determined pressure is maintained between the heated platen and the lower platen for a specified dwell time. After, the heated platen is moved away from the lower platen. Then the decorated flying disc toy is removed.

The pad performs several functions. The pad urges the portion of the fabric cover spanning the space bounded by the ring toward the dye-sublimation paper, thereby creating an upward bulge in the fabric cover. This upward bulge ensures intimate direct contact with the dye-sublimation paper. The pad also supports the flying disc toy at a sufficient height above the lower platen to avoid crushing the ring when the heated platen is moved towards the lower platen and the determined pressure is maintained between the heated platen and the lower platen.

The temperature of the heated platen exceeds the melting point of the ring and is effective for dye-sublimation printing. Thus, without the insulating mask covering the ring, the ring would melt.

The determined pressure exceeds a maximum stress that the ring can support without being crushed and is effective for dye-sublimation printing. Thus, without the pad, the ring could be crushed during pressing.

The mask, by way of example and not limitation, may be a heat resistant cardboard, a heat resistant silicone sheet, a high temperature felt, a polytetrafluoroethylene (PTFE) sheet, or a laminate that includes a plurality of thermal insulating sheets.

The pad, by way of example and not limitation, may be a carbon foam mat or a high temperature felt mat. Optionally, the pad may be attached to the lower platen with hook and loop fasteners, to hold the pad in the proper position and avoid shifting during the transfer process.

BRIEF DESCRIPTION OF THE DRAWINGS

The foregoing and other aspects, objects, features and advantages of the invention will become better understood with reference to the following description, appended claims, and accompanying drawings, where:

Figure 1:
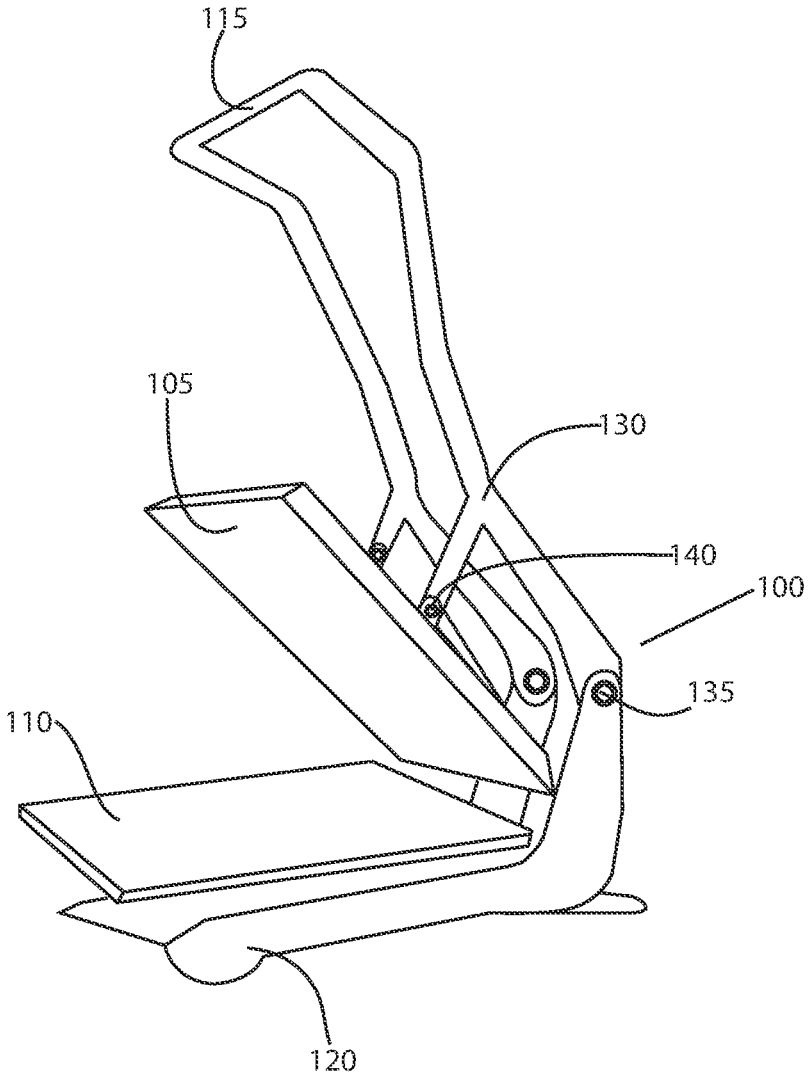
FIG. 1 conceptually illustrates a clamshell heat press for dye-sublimation printing onto a manufactured flying disc toy according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects, proportions, steps or sequence of steps as shown in the figures.

DETAILED DESCRIPTION

A conventional dye-sublimation heat press includes a lower table (aka lower platen), a heated platen, and a controller. Both manual and automatic heat presses are widely available. The substrate, i.e., fabric, onto which a subject matter will be printed by dye-sublimation, is placed between the lower table and heated platen. The heated platen applies heat and pressure to the substrate and overlaid dye-sublimation paper. In a clamshell heat press, the upper heated platen in the press opens like a clamshell, while in a swing-away heat press, the heated platen swings away from the lower platen. A drawer style press allows for the lower table to be pulled out like a drawer away from the heat for preparation of the paper and substrate. Vacuum presses, which utilize air pressure to provide the necessary force, can achieve high psi ratings.

Using a dye-sublimation printer, which are widely available, subject matter is printed in sublimation dyes on sublimating paper. The sublimating paper is then placed between the fabric and heated platen, with the printed subject matter facing the fabric.

After the paper and substrate are positioned, the heated platen is moved towards the lower table. In a manual clamshell heat press this may be accomplished by moving a handle downward, which causes downward motion of the heated platen via a clamping linkage. In an automatic heat press, an actuator mechanism may move the heated platen and or table to achieve the clamping effect.

The press includes temperature and pressure regulating components. A controller, i.e., an electrical control unit, regulates the temperature of the heated platen. Various pressure regulation mechanisms may be included. Such mechanisms may include springs, gas shocks and adjustment screws for adjusting the distance between the platen and table in the clamped position.

Proper temperature, pressure (20 to 40 psi) and dwell time (15 to 60 seconds) are important for successful dye-sublimation. Typically, sublimation presses operate at around 400° F. degrees. By way of example, an image may be transferred to certain polyester fabrics in 35 seconds at 400° F. at 20 to 40 psi. However, some sublimation papers and thin, soft fabrics might warrant a temperature as low as 350° F. for a longer dwell time. Dye and paper manufacturers, and fabric manufacturers, may recommend temperature, pressure, and dwell time for effective dye-sublimation printing. Otherwise, these parameters may be determined experimentally, by running sacrificial substrates through the process to achieve the desired results.

A flying disc toy in accordance with principles of the invention includes a ring and fabric cover. The ring is in the form of a torus. The ring has a top and a bottom. A circular-cross section space is bounded by the ring. By way of example, the ring may be comprised of a length of tubing or hose bent into a circular shape. The ends of the length of tubing may be attached together, such as by mechanical fastening and/or chemical or ultrasonic bonding. The ring defines the peripheral shape of the disc toy and provides a framework for supporting the fabric cover.

The ring may be comprised of a plastic, such as (but not limited to) a vinyl, e.g., polyvinyl chloride (PVC), and/or a natural rubber. The tubing may have a melting point that is well below the temperature for dye sublimation. For example, the melting point of PVC can be as low as 212° F., depending upon the additives included in the PVC blend. Thus, if exposed to the heated platen for an appreciable time, the ring may melt. Such melting may damage the disc toy.

The fabric cover surrounds the ring and, at the top of the ring, covers the central space bounded by the ring. The fabric cover must contain a substantial polymer content for effective dye-sublimation. Polyester is a non-limiting example of a fabric that contains a substantial polymer content for effective dye-sublimation. Sublimation delivers beautiful, high-definition and permanent colors that are embedded into the fabric cover rather than applied on top of the fabric cover. The high temperature and pressure of a heat press cause dye solids on the sublimation paper to sublimate into colored gas. The high temperature and pressure also cause pores in the polymers of the fabric cover to open up. The colored gas fills the open pores of the polymers. When the press opens the pores close, trapping the gas inside the polymers.

An insulating mask protects the ring from the temperature of the heated platen. The mask covers the ring (e.g., the ring covered by the fabric), but does not cover much, if any, of the space bounded by the ring. The mask is a thin insulating material, preferably not thicker than ¼-inch and more preferably not thicker than ⅛-inch. The mask is a poor thermal conductor that can withstand the heat and pressure of the heat press over repeated cycles. In one non-limiting embodiment, the mask is comprised of a heat resistant cardboard. Alternatively, the mask may be formed from a silicone sheet capable of withstanding 500° F. temperatures, a high temperature felt such as an aramid felt, or a polytetrafluoroethylene (PTFE) sheet, or another thin sheet insulating material that is capable of withstanding temperatures of 400° F., at about 40 psi, over repeated cycles of about up to 1 minute in duration. A plurality of insulating masks may be stacked, one on top of the other, to provide increased thermal insulation. A single mask and a laminate comprised of a plurality of stacked insulating masks are referred to herein as a mask.

A pad is provided to support the area of the fabric cover on which dye sublimation will take place. The pad may be compressible or substantially incompressible. The pad is thicker (e.g., slightly thicker) than the height of the ring. If the ring is formed from a flexible tube, the pad is thicker than the outer diameter of the tube. By way of example and not limitation, the thickness of the pad may exceed the height of the ring by 1% to 20%. The pad is sized and shaped to occupy most of the space bounded by the ring. The pad supports (i.e., pushes or rests against) the portion of the fabric onto which subject matter will be printed via dye sublimation. The pad also supports the disc toy a sufficient height above the table to avoid crushing the ring during pressing. The pressure exerted by the press exceeds the maximum stress that the ring can support without being crushed. Thus, without the support of the pad, the ring could be permanently damaged.

One nonlimiting example of a suitable pad is a carbon foam mat that has been cut to a cross sectional shape that fits within the space bounded by the ring, and occupies most, if not all, of the bounded space, and has a height that is greater (e.g., slightly greater) than the height of the ring. Such a pad is compressible, heat and pressure resistant, and capable of urging the targeted portion of the cover upward toward the heated platen for effective dye sublimation printing.

Another nonlimiting example of a suitable pad is a high temperature felt mat that has been cut to a cross sectional shape that fits within the space bounded by the ring, and occupies most, if not all, of the bounded space, and has a height that is greater (e.g., slightly greater) than the height of the ring. Such a pad is also compressible, heat and pressure resistant, and capable of urging the targeted portion of the cover upward toward the heated platen for effective dye sublimation printing.

In one implementation, the pad is a separate removable component that can be installed on any press table. In another implementation, the pad is attached (e.g., removably attached) to the press table, such as with hook and loop fasteners.

During printing, the pad is disposed between the table and the underside (bottom) the fabric cover. The pad exerts pressure against the underside of the fabric cover when the press is closed. The pressure causes the top side of the fabric over to bulge outwardly, even with or slightly above the height of the insulating mask. The outwardly bulged top surface provides a substrate for effective dye-sublimation printing.

Referring now to FIG. 1, an exemplary manual clamshell heat press 100 for dye-sublimation printing onto a manufactured flying disc toy according to principles of the invention is conceptually illustrated. The heat press 100 includes a heated platen 105 (i.e., the upper platen), a table 110 (i.e., the lower platen), a support stand 120, a handle 115 coupled to linkage 130 and hinged joints 135, 140. After the paper and a substrate are positioned, the heated platen 105 may be moved towards the lower table 110 by moving the handle 115 downward, which causes downward motion of the heated platen 105 via a clamping linkage 130. The heated platen 105 contains a heating element that is controlled by an electrical controller (not shown).

Figure 2:
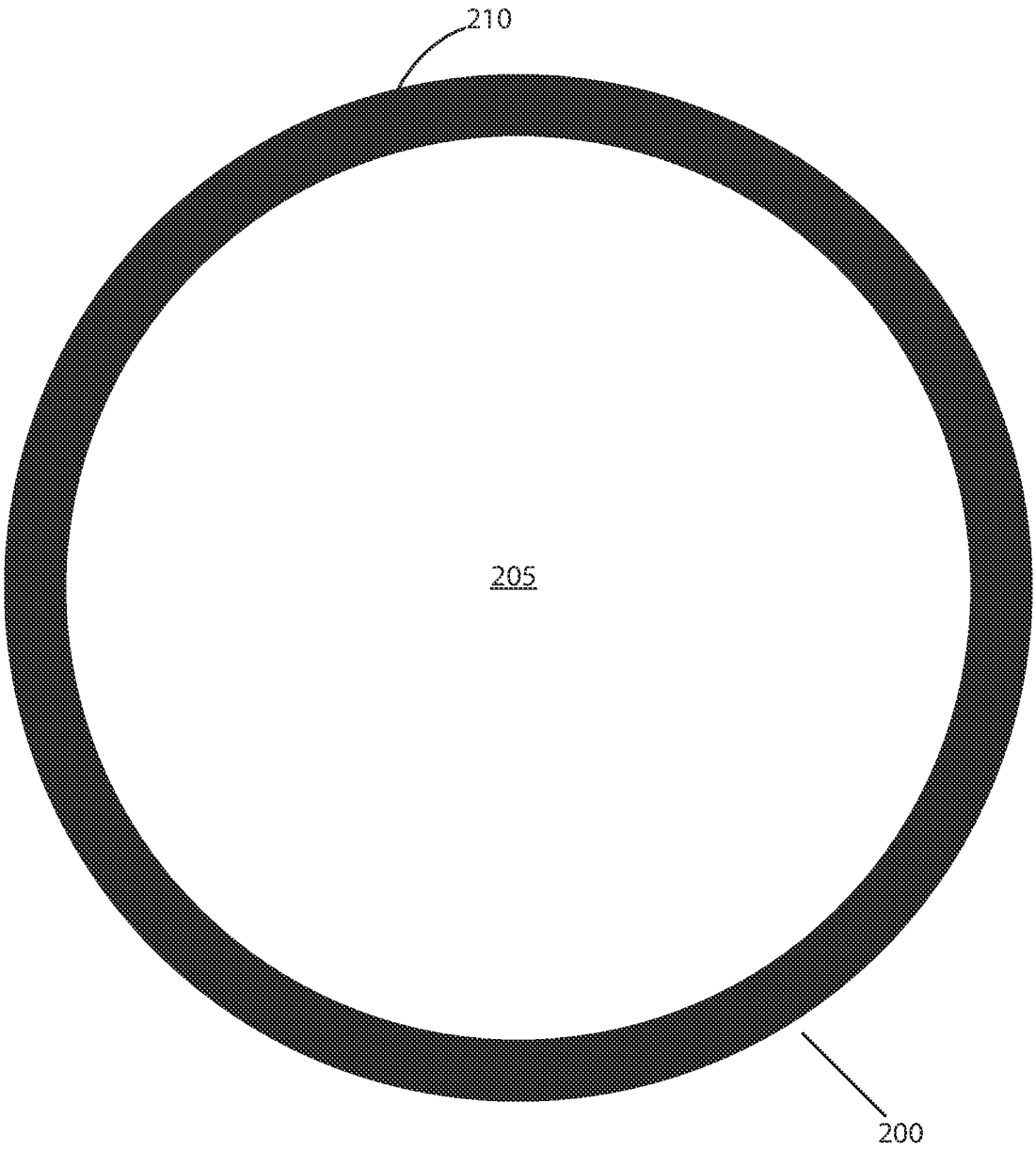
FIG. 2 is a plan view of an exemplary flying disc toy for dye-sublimation printing according to principles of the invention.
Figure 3:
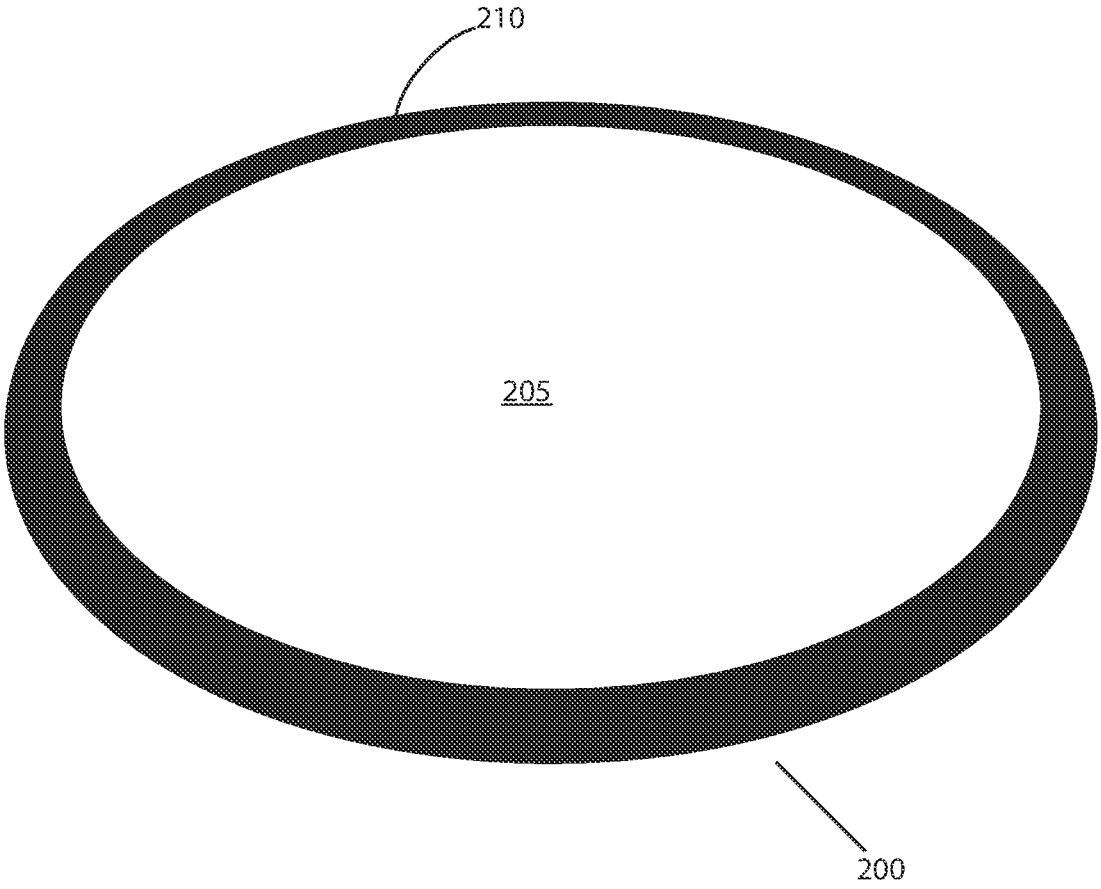
FIG. 3 is a perspective view of an exemplary flying disc toy for dye-sublimation printing according to principles of the invention.
Figure 4:
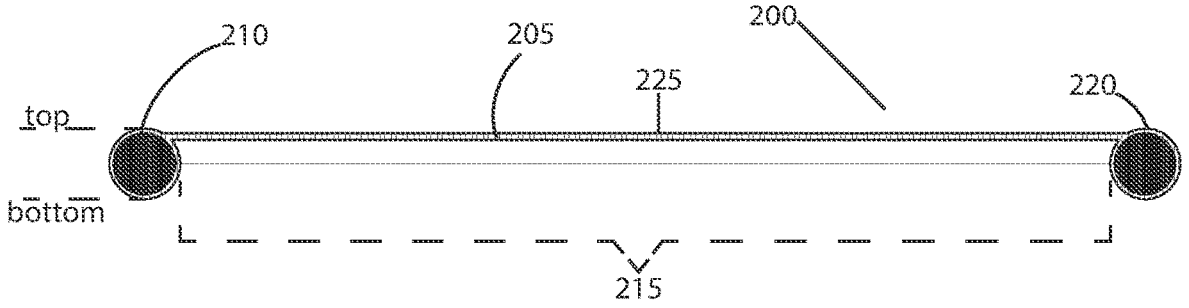
FIG. 4 is a section view of an exemplary blank flying disc toy for dye-sublimation printing according to principles of the invention.

FIGS. 2 through 3 conceptually illustrate an exemplary flying disc toy 200 for dye-sublimation printing according to principles of the invention. The exemplary flying disc toy 200 includes a ring 210 and a fabric cover 205. The ring 210 is in the form of a torus. The ring has a top and a bottom, as conceptually illustrated in the sectional view of FIG. 4. A generally circular-cross section space 215 is bounded by the ring 210.

In an exemplary embodiment, the portion 220 of the fabric cover 205 that covers the ring 210, is black in color. The black color conceals any overprint bleed and gas from the sublimated dyes that may migrate onto the rim. If that portion was a light color (e.g., white or gray), instead of black, any overprint and migrated dye might appear as colored mist. In one embodiment, the portion 220 of the fabric cover 205 that covers the ring 210 and the portion 225 of the fabric cover 205 onto which the sublimated dye will be transferred are a single piece of fabric, with the portion 220 of the fabric cover 205 that covers the ring 210 being dyed black. In another embodiment, the portion 220 of the fabric cover 205 that covers the ring 210 and the portion 225 of the fabric cover 205 onto which the sublimated dye will be transferred are separate pieces of fabric that are joined together via stitching and/or bonding, with the portion 220 of the fabric cover 205 that covers the ring 210 being black.

In an exemplary embodiment, the portion 225 of the fabric cover 205 onto which the sublimated dye will be transferred is white (e.g., Optic White polyester or other Optic White high polymer fabric). Sublimation dyes are semi-transparent and are generally used in combinations of four, six and eight colors to attain a desired high-definition photo real print. In an exemplary implementation, sublimation dyes are digitally blended in a CMYK four color process to achieve certain colors, shading or textures. Usually there are no white sublimation dyes used in the four color process. Therefore, a white area in a specific design will show up as a blank space on the dye-sublimation transfer paper, where no ink is applied. Whatever color the substrate is will show in that space instead. Thus, a white substrate works best when looking to attain specific colors and include white spaces. True white will appear in areas of a design where no ink is applied, and the remaining colors will be as intended. Concomitantly, a white substrate results in a vibrant image, with clear detail, because the white background reinforces the colors of the image. If the substrate was gray instead of white, all spaces would show up as gray and other colors would have a gray hue to them.

The ring 210 may be comprised of a length of tubing or hose bent into a circular shape. The ends of the length of tubing may be attached together, such as by mechanical fastening and/or chemical or ultrasonic bonding. The ring 210 defines the peripheral shape of the disc toy and provides a framework for supporting the fabric cover 205.

The tubing of the ring 210 may be comprised of a plastic, such as (but not limited to) a vinyl, e.g., polyvinyl chloride (PVC), which may have a melting point that is well below the temperature for dye-sublimation. If exposed to the heated platen 105 for an appreciable time, the ring 210 may melt. Such melting may damage the toy 200.

The fabric cover includes a few portions. A portion 220 of the fabric cover 205 surrounds the ring 210. At the top of the ring 210, another portion of the fabric cover 205 spans and covers the central space 215 bounded by the ring 210. The portion of the fabric cover 205 that spans and covers the central space 215 bounded by the ring 210 is designated as 225 in FIG. 4.

The fabric cover 205 contains a substantial polymer content for effective dye-sublimation. Polyester is a nonlimiting example of a material for a fabric cover 205 for effective dye-sublimation, according to principles of the invention. The high temperature and pressure of the heat press 100 causes dye solids on the sublimation paper to sublimate into colored gas. The high temperature and pressure also cause pores in the polymers of the fabric cover 205 to open up. The colored gas fills the open pores of the polymers. When the press 100 opens, the pores close, trapping the gas inside the polymers.

Figure 5:
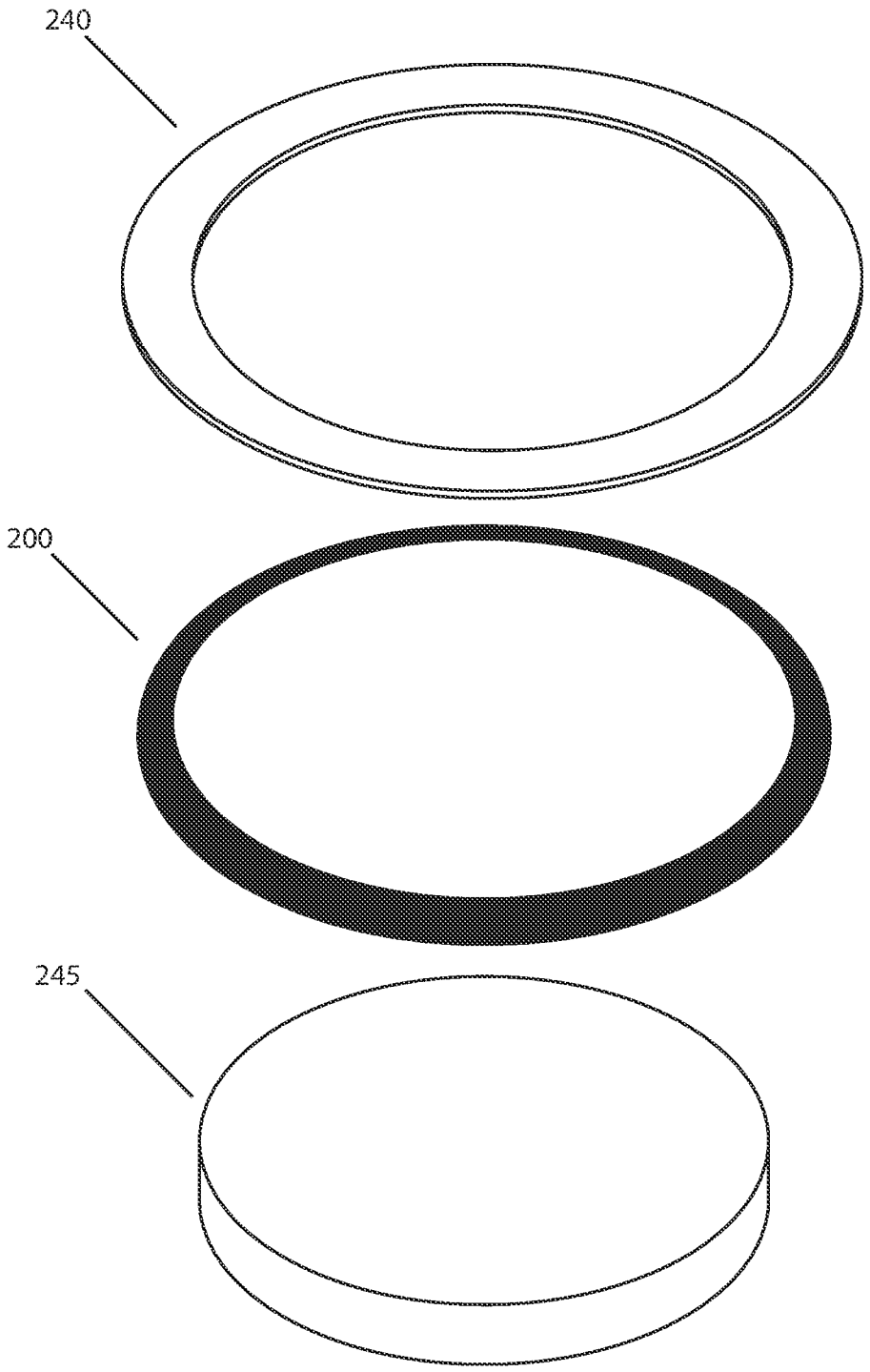
FIG. 5 is an exploded perspective view of an exemplary flying disc toy, pad and mask for dye-sublimation printing according to principles of the invention.

FIG. 5 provides an exploded perspective view of an exemplary flying disc toy 200, pad 245 and mask 240 for dye-sublimation printing according to principles of the invention. The insulating mask 240 protects the ring from the temperature of the heated platen. The mask 240 covers the ring (e.g., the ring covered by the fabric), but does not cover much, if any, of the space bounded by the ring 210 or the portion 225 of the fabric cover 205 that spans and covers the central space 215 bounded by the ring 210.

The mask 240 is a thin insulating material, preferably not thicker than ¼-inch and more preferably not thicker than ⅛-inch. The mask 240 is a poor thermal conductor that can withstand the heat and pressure of the heat press 100 over repeated cycles. In one non-limiting embodiment, the mask 240 is comprised of a heat resistant cardboard. Alternatively, the mask 240 may be formed from a silicone sheet capable of withstanding 500° F. temperatures, a high temperature felt such as an aramid felt, or a polytetrafluoroethylene (PTFE) sheet, or another thin sheet insulating material that is capable of withstanding temperatures of 400° F., at about 40 psi, over repeated cycles of about up to 1 minute in duration. A plurality of insulating masks may be stacked, one on top of the other, to provide increased thermal insulation. A single mask and a laminate comprised of a plurality of stacked insulating masks are referred to herein as a mask. Thus, in FIG. 5, mask 240 may represent a single layer mask, or a laminate comprised of multiple bonded and/or stacked layers.

Figure 7:
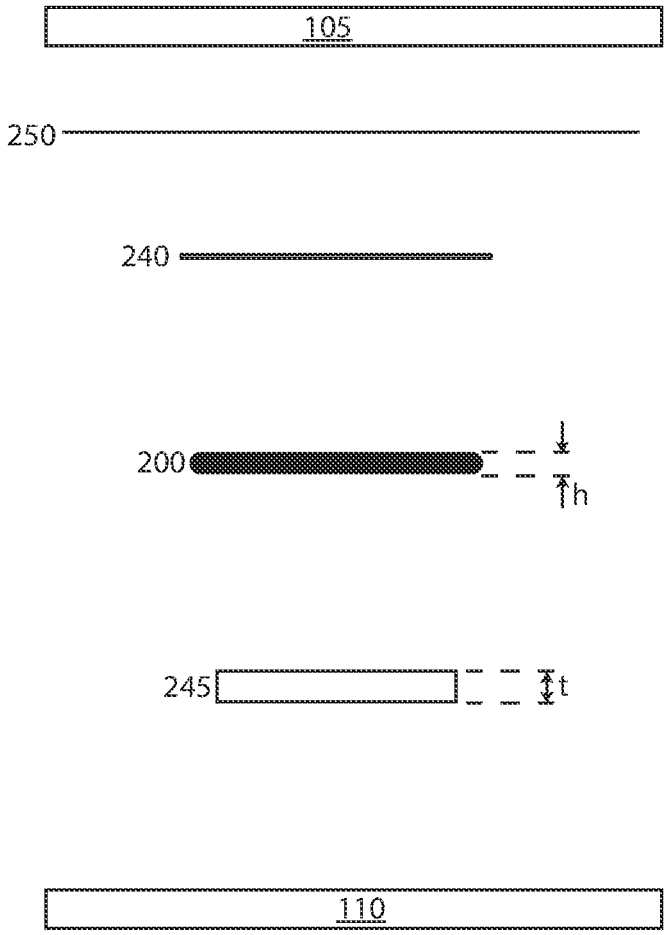
FIG. 7 is a side exploded view of an exemplary flying disc toy, pad, mask and dye-sublimation printing paper between a table and heated platen for dye-sublimation printing according to principles of the invention.

A pad 245 is provided to support (from the underside) the portion 225 of the fabric cover on which dye sublimation will take place. The pad 245 may be compressible or substantially incompressible. The pad 245 is thicker (e.g., slightly thicker) than the height, h, of the ring (FIG. 7). If the ring 210 is formed from a flexible tube, the pad is thicker than the outer diameter of the tube. By way of example and not limitation, the thickness, t, of the pad 245 may exceed the height, h, of the ring 200 by 1% to 20%. The pad 245 is sized and shaped to occupy most of the space 215 bounded by the ring 210. The pad 245 supports (i.e., pushes or rests against) the portion 225 (i.e., targeted portion) of the fabric cover 205 onto which subject matter will be printed via dye-sublimation. During pressing, the pad 245 supports the toy 200 a sufficient height above the table 110 to avoid crushing the ring 210. The pressure exerted by the press 100 exceeds the maximum stress that the ring 210 can support without being crushed. Thus, without the support of the pad 245, the ring 210 could be permanently damaged. During pressing, the ring 210 may become slightly compressed if the pad is compressible and the pressure is sufficient. However, the ring 210 will return substantially to its uncompressed state after the pressure is relieved.

One nonlimiting example of a suitable pad 245 is a carbon foam mat that has been cut to a shape (e.g., cylindrical shape) that fits within the space 215 bounded by the ring 210, and occupies most, if not all, of the bounded space 215, and has a height (i.e., thickness, t) that is greater (e.g., slightly greater) than the height, h, of the ring 210. Such a pad 245 is compressible, heat and pressure resistant, and capable of urging the targeted portion 225 of the cover 205 upwardly toward the heated platen 105 for effective dye-sublimation printing.

Another nonlimiting example of a suitable pad 245 is a high temperature felt mat that has been cut to a shape (e.g., cylindrical shape) that fits within the space 215 bounded by the ring 210, and occupies most, if not all, of the bounded space 215, and has a height (i.e., thickness, t) that is greater (e.g., slightly greater) than the height, h, of the ring 210. Such a pad 245 is compressible, heat and pressure resistant, and capable of urging the targeted portion 225 of the cover 205 upwardly toward the heated platen 105 for effective dye-sublimation printing.

In one implementation, the pad 245 is a separate removable component that can be installed on any press table. In another implementation, the pad 245 is attached (e.g., removably attached) to the press table 110, such as with hook and loop fasteners.

Figure 6:
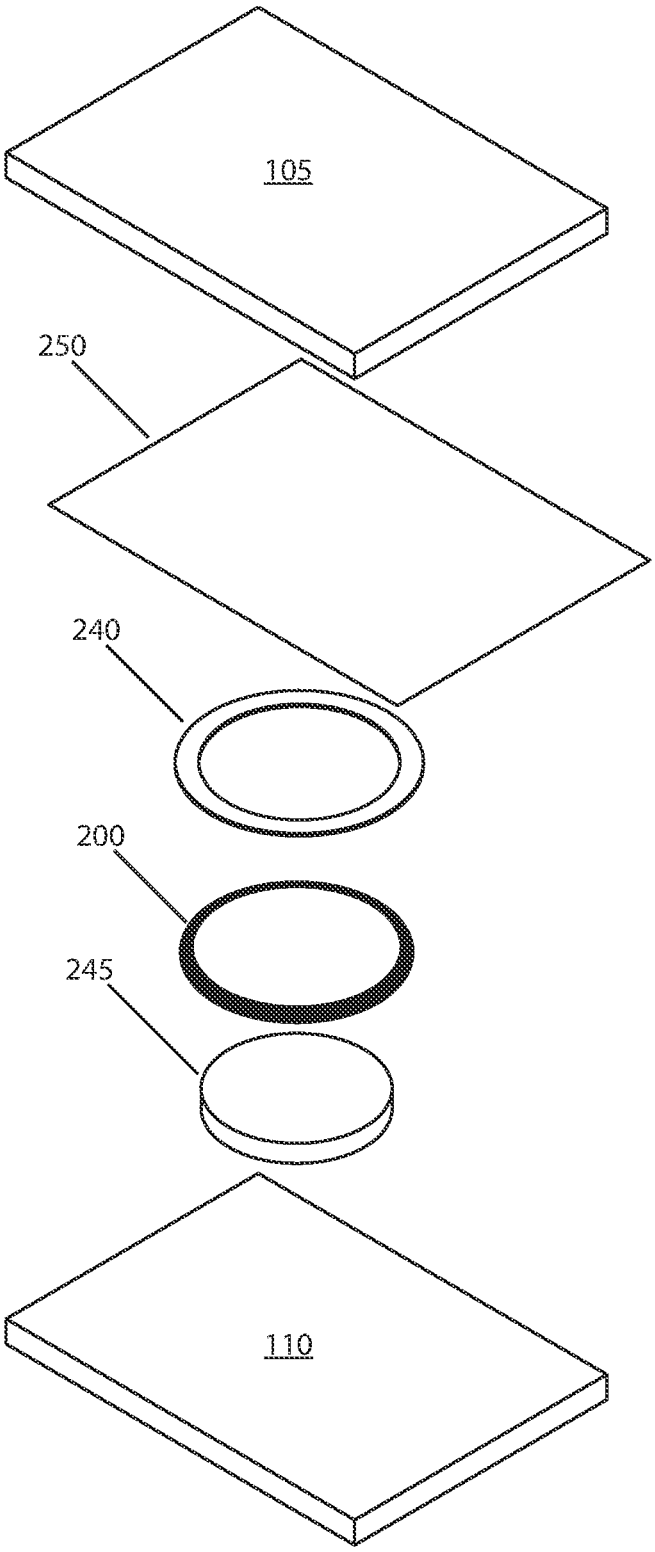
FIG. 6 is an exploded perspective view of an exemplary flying disc toy, pad, mask and dye-sublimation printing paper between a table and heated platen for dye-sublimation printing according to principles of the invention.
Figure 8:
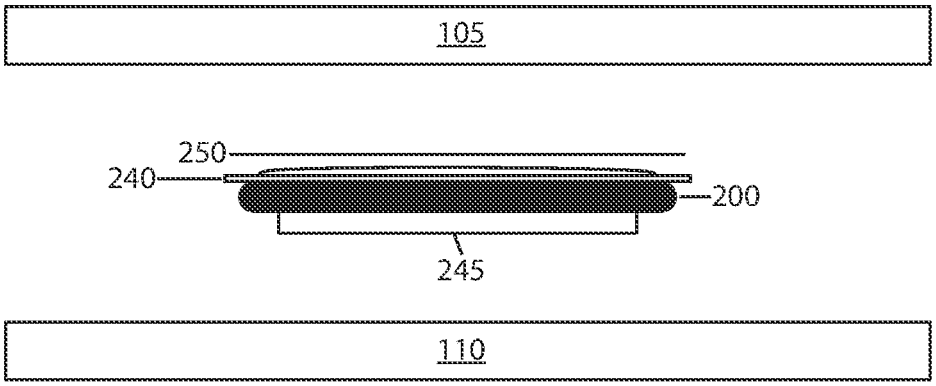
FIG. 8 is a side view of an exemplary flying disc toy, pad, mask and dye-sublimation printing paper between a table and heated platen for dye-sublimation printing according to principles of the invention.
Figure 9:
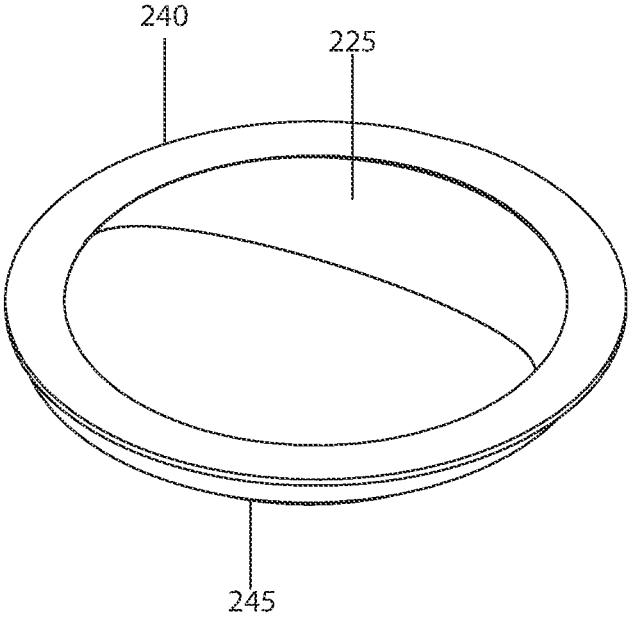
FIG. 9 is a perspective view of an exemplary flying disc toy, pad and mask, with the pad urging the fabric cover of the flying disc toy upward for dye-sublimation printing according to principles of the invention.

FIGS. 6 through 8 conceptually illustrate an exemplary flying disc toy 200, pad 245, mask 240 and dye-sublimation printing paper 250 between a table 110 and heated platen 105 for dye-sublimation printing according to principles of the invention. The pad 245 is disposed between the toy 200 and table 110. The pad 245 urges the targeted portion 225 of the fabric cover 205 toward the dye-sublimation paper 250, as conceptually illustrated in FIG. 9. The fabric cover 205 has enough slack to allow such upward bulging of the targeted portion 225. The bulging ensures intimate contact between the dye-sublimation paper 250 and the targeted portion 225 of the fabric cover 205. The toy 200 is disposed between the pad 245 and the mask 240. During pressing, the mask 240 insulates the ring 210 from heat transferred from the heated platen 105, to maintain the ring 210 intact below its melting point. The dye-sublimation paper 250 is disposed between the heated platen 105 and the mask 240. The pad 245 supports the toy 200 a sufficient height above the table 110 to avoid crushing the ring 210 between the heated platen 105 and table 110 during pressing.

The side of the dye-sublimation paper 250 that contains printed subject matter faces the toy 200. The printed subject matter will be transferred to the targeted portion 225 of the fabric cover 205 when sufficient heat and pressure are applied, via movement of the heated platen 105 towards the table 110 to press the items disposed therebetween, for an effective dwell time. The printed subject matter is positioned and sized to fit onto the targeted portion 225 of the fabric cover 205.

Figure 10:
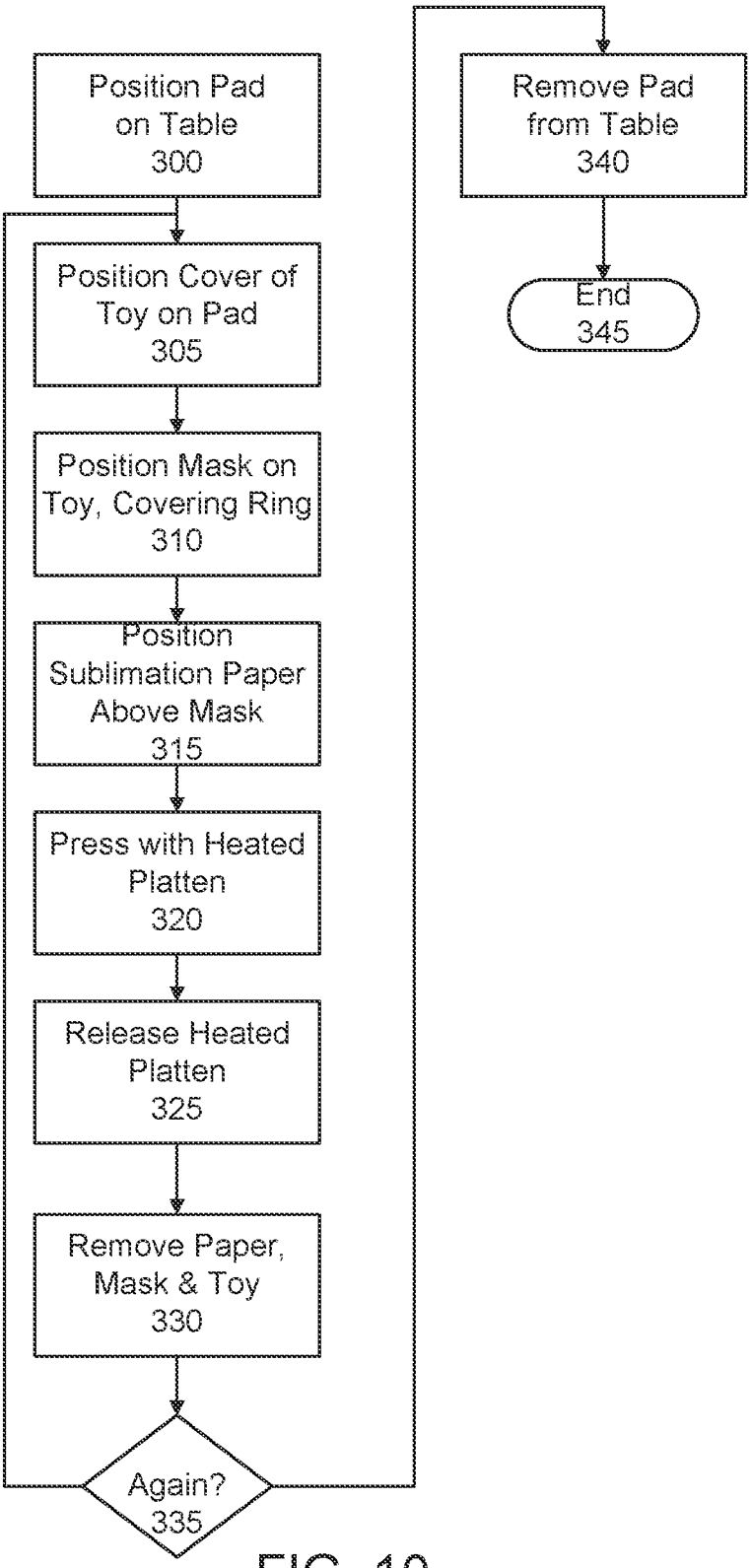
FIG. 10 is a high-level flowchart for steps of an exemplary dye-sublimation printing process according to principles of the invention.

FIG. 10 provides a high-level flowchart for steps of an exemplary dye-sublimation printing process according to principles of the invention. In step 300, the pad 245 is positioned on the table 110. The pad 245 may be placed upon and/or releasably attached to the table 110.

In step 305, the toy 200 is positioned on the pad 245, with the pad 245 extending into the bounded space 215 and the top of the pad supporting the targeted portion 225 of the fabric cover 205. The pad 245 supports the toy 200 a sufficient height above the table 110 to avoid crushing the ring 210 between the heated platen 105 and table 110 during pressing. The pad 245 urges the targeted portion 225 of the fabric cover 205 toward the dye-sublimation paper 250, thereby creating an upward bulge, during pressing. The fabric cover 205 has enough slack to allow such upward bulging of the targeted portion 225. The bulging ensures intimate contact between the dye-sublimation paper 250 and the targeted portion 225 of the fabric cover 205.

In step 310, the mask 240 is placed on the toy 200 over the ring 210. During pressing, the mask 240 insulates the ring 210 from heat transferred from the heated platen 105, to maintain the ring 210 intact below its melting point.

In step 315, the dye-sublimation paper 250 is placed upon the mask 240. The side of the dye-sublimation paper 250 that contains printed subject matter faces the toy 200. The printed subject matter will be transferred to the targeted portion 225 of the fabric cover 205, via sublimation, when sufficient heat and pressure are applied, via movement of the heated platen 105 towards the table 110 to press the items disposed therebetween, for an effective dwell time. The printed subject matter is positioned and sized to fit onto the targeted portion 225 of the fabric cover 205.

In step 320, pressing occurs. The heated platen 105 has been heated to a temperature effective for dye-sublimation. The heated platen 105 is moved towards the table 110 until a determined pressure is achieved. The determined pressure is suitable for dye-sublimation printing. When the pressure is achieved, the heated platen is held in the position for a dwell time. The heat and pressure cause printing via dye-sublimation. The printed subject matter is transferred from the dye-sublimation paper 250 to the targeted portion 225 of the fabric cover 205. The mask 240 insulates the ring 210 from the heat of the heated platen 105. The pad 245 ensures intimate contact between the dye-sublimation paper 250 and the targeted portion 225 of the fabric cover 205 during this step. Concomitantly, the pad 245 supports the toy 200 a sufficient height above the table 110 to avoid crushing the ring 210 between the heated platen 105 and table 110 during pressing.

When the dwell time has elapsed, the heated platen 105 may be released, as in step 325. Releasing entails moving the heated platen 105 away from the table 110. Pressure is relieved.

After releasing, items may be removed, as in step 330. In an exemplary implementation, the paper 250, mask 240, and toy 200 are removed. These may be removed together or sequentially (e.g., first the paper 250, then the mask 240 and then the toy 200).

If the process will be repeated for another toy, as in step 335, the steps are repeated, starting with step 305. If the process will not be repeated, then the pad 245 may be removed from the table 110, as in step 340 and the process ends, as in step 345. The press 100 may be turned off (deactivated), allowing the heated platen 105 to cool for safe storage.

Figure 11:
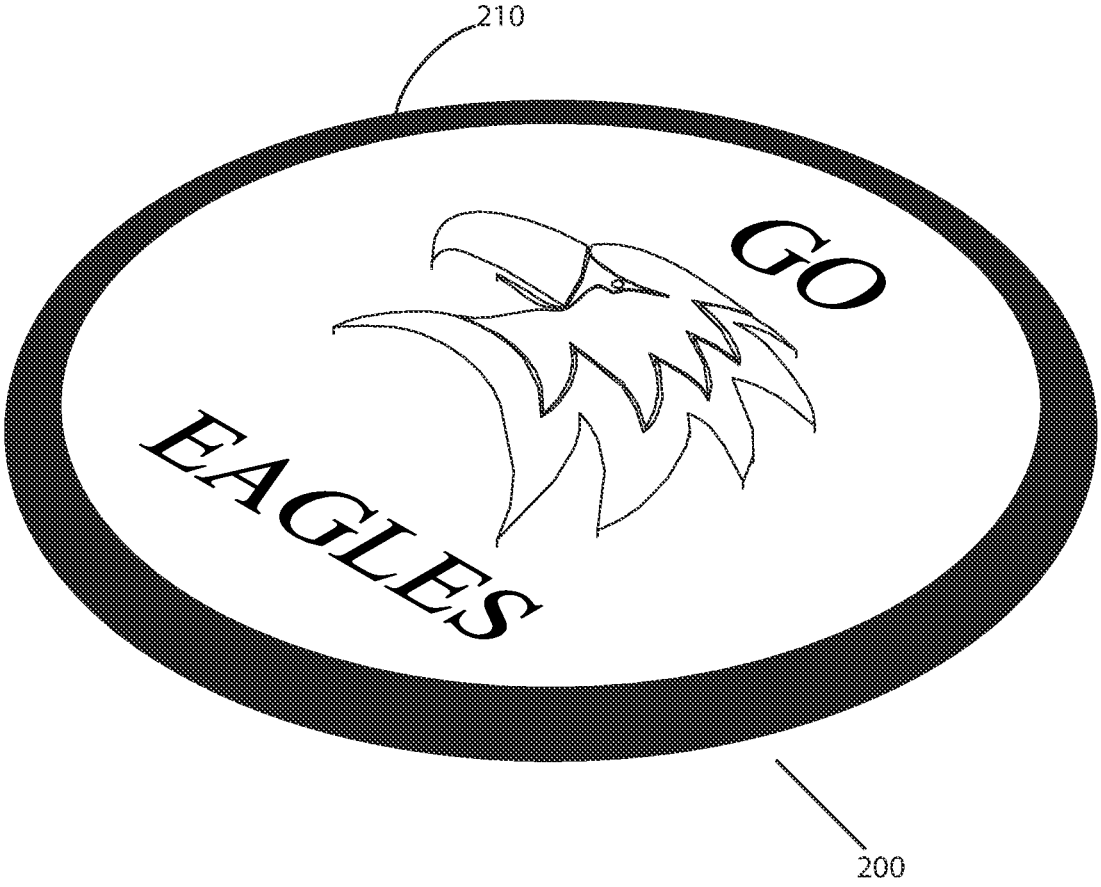
FIG. 11 conceptually illustrates a flying disc toy with a non-limiting example of an image and alphanumeric characters on the fabric cover.

FIG. 11 conceptually illustrates a flying disc toy 200 with a non-limiting example of an image and alphanumeric characters on the fabric cover. The image and alphanumeric characters may be in any color and combinations and shadings of colors. The invention is not limited to any particular image or to any particular alphanumeric characters.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of dye-sublimation printing on a manufactured flying disc toy, the method comprising steps of:

positioning a pad on a lower platen of a heat press, positioning a flying disc toy on the pad, the flying disc toy comprising a ring and a fabric cover, the flying disc toy having a top, a bottom and a height from the bottom to the top, the fabric cover including a portion spanning a space bounded by the ring at the top of the flying disc toy, the bottom of the flying disc toy facing the lower platen, and the pad being shaped and sized to occupy most of the space bounded by the ring, and a thickness of the pad exceeding the height of the ring;

positioning a mask on the flying disc toy at the top of the flying disc toy, the mask providing thermal insulation, the mask covering the ring of the flying disc toy, and the mask not covering most of the portion of the fabric cover spanning the space bounded by the ring;

positioning dye-sublimation paper over the portion of the fabric cover spanning the space bounded by the ring, the dye-sublimation paper including a printed side facing the portion of the fabric cover spanning the space bounded by the ring, and the printed side included printed subject matter, the printed subject matter being printed in dye-sublimation ink;

moving a heated platen towards the lower platen, with the dye-sublimation paper on the fabric cover spanning the space bounded by the ring, and the mask over the ring of the flying disc toy, and the pad supporting the flying disc toy on the lower platen, disposed between the heated platen and the lower platen;

maintaining at least a determined pressure between the heated platen and the lower platen for a dwell time;

moving the heated platen away from the lower platen; and removing the flying disc toy.

2. The method of dye-sublimation printing on a manufactured flying disc toy according to claim 1, the pad urging the portion of the fabric cover spanning the space bounded by the ring toward the dye-sublimation paper, thereby creating an upward bulge in the fabric cover.

3. The method of dye-sublimation printing on a manufactured flying disc toy according to claim 1, the pad supporting the flying disc toy a sufficient height above the lower platen to avoid crushing the ring when the heated platen is moved towards the lower platen and the determined pressure is maintained between the heated platen and the lower platen.

4. The method of dye-sublimation printing on a manufactured flying disc toy according to claim 1, a temperature of the heated platen exceeding the melting point of the ring and being effective for dye-sublimation printing.

5. The method of dye-sublimation printing on a manufactured flying disc toy according to claim 1, the determined pressure exceeding a maximum stress that the ring can support without being crushed and being effective for dye-sublimation printing.

6. The method of dye-sublimation printing on a manufactured flying disc toy according to claim 1, the mask comprising a heat resistant cardboard.

7. The method of dye-sublimation printing on a manufactured flying disc toy according to claim 1, the mask comprising a heat resistant silicone sheet.

8. The method of dye-sublimation printing on a manufactured flying disc toy according to claim 1, the mask comprising a high temperature felt.

9. The method of dye-sublimation printing on a manufactured flying disc toy according to claim 1, the mask comprising a polytetrafluoroethylene (PTFE) sheet.

10. The method of dye-sublimation printing on a manufactured flying disc toy according to claim 1, the mask comprising a laminate including a plurality of thermal insulating sheets.

11. The method of dye-sublimation printing on a manufactured flying disc toy according to claim 1, the pad comprising a carbon foam mat.

12. The method of dye-sublimation printing on a manufactured flying disc toy according to claim 1, the pad comprising a high temperature felt mat.

13. The method of dye-sublimation printing on a manufactured flying disc toy according to claim 1, the pad being attached to the lower platen with hook and loop fasteners.

14. The method of dye-sublimation printing on a manufactured flying disc toy according to claim 2, the pad supporting the flying disc toy a sufficient height above the lower platen to avoid crushing the ring when the heated platen is moved towards the lower platen, and the determined pressure is maintained between the heated platen and the lower platen.

15. The method of dye-sublimation printing on a manufactured flying disc toy according to claim 14, a temperature of the heated platen exceeding the melting point of the ring.

16. The method of dye-sublimation printing on a manufactured flying disc toy according to claim 15, the determined pressure exceeding a maximum stress that the ring can support without being crushed and being effective for dye-sublimation printing.

17. The method of dye-sublimation printing on a manufactured flying disc toy according to claim 16, the mask comprising one of a heat resistant cardboard, heat resistant silicone sheet, a high temperature felt and a polytetrafluoroethylene (PTFE) sheet.

18. The method of dye-sublimation printing on a manufactured flying disc toy according to claim 16, the mask comprising a laminate including a plurality of thermal insulating sheets.

19. The method of dye-sublimation printing on a manufactured flying disc toy according to claim 16, the pad comprising one of a carbon foam mat and a high temperature felt mat.

20. The method of dye-sublimation printing on a manufactured flying disc toy according to claim 16, the pad being attached to the lower platen with hook and loop fasteners.

* * * * *